US011564503B2

(12) United States Patent
Gregory

(10) Patent No.: US 11,564,503 B2
(45) Date of Patent: Jan. 31, 2023

(54) ERGONOMIC BODY PILLOW

(71) Applicant: Joshua Paul Gregory, Kirkwood, PA (US)

(72) Inventor: Joshua Paul Gregory, Kirkwood, PA (US)

( * ) Notice: Subject to any disclaimer, the term of this patent is extended or adjusted under 35 U.S.C. 154(b) by 0 days.

(21) Appl. No.: 17/446,350

(22) Filed: Aug. 30, 2021

(65) Prior Publication Data

US 2022/0061541 A1 Mar. 3, 2022

Related U.S. Application Data

(60) Provisional application No. 63/072,469, filed on Aug. 31, 2020.

(51) Int. Cl.

| | |
|---|---|
| ***A47C 20/02*** | (2006.01) |
| ***A47G 9/10*** | (2006.01) |
| ***A47G 9/02*** | (2006.01) |
| ***A47C 20/00*** | (2006.01) |

(52) U.S. Cl.

CPC ..... *A47C 20/021* (2013.01); *A47C 20/02* (2013.01); *A47G 9/10* (2013.01); *A47G 9/0253* (2013.01)

(58) Field of Classification Search

CPC ..... A47C 20/021; A47C 20/02; A47C 7/38; A47C 7/386; A47C 7/36; A47G 9/10; A47G 9/0253

USPC ..... 5/632, 630, 490

See application file for complete search history.

(56) References Cited

U.S. PATENT DOCUMENTS

| | | | | |
|---|---|---|---|---|
| 4,394,783 | A | 7/1983 | Simmons | |
| 4,624,021 | A | 11/1986 | Hofstetter | |
| 4,754,510 | A * | 7/1988 | King | A47C 20/023 D6/601 |
| 4,794,657 | A | 1/1989 | Avery | |
| 4,901,384 | A | 2/1990 | Eary | |
| 5,269,322 | A * | 12/1993 | Mandel | A61F 5/3715 128/845 |
| 5,515,563 | A * | 5/1996 | Chao | A63H 3/003 5/907 |
| 5,978,990 | A | 11/1999 | Akey | |
| 5,987,674 | A | 11/1999 | Schaffner et al. | |
| 6,601,252 | B1 | 8/2003 | Leach | |
| 6,708,354 | B1 | 3/2004 | Carter et al. | |
| 6,760,934 | B1 | 7/2004 | Leach | |
| 6,874,183 | B1 | 4/2005 | Taylor | |
| 7,089,614 | B1 | 8/2006 | Clapp | |
| 7,793,371 | B1 | 9/2010 | Leach | |
| 9,155,399 | B1 | 10/2015 | Zenoff | |
| 10,827,843 | B2 * | 11/2020 | Miller | A47C 20/025 |
| 2005/0060806 | A1 | 3/2005 | Wilkinson | |
| 2007/0067914 | A1 | 3/2007 | Littlehom et al. | |
| 2013/0232691 | A1 | 9/2013 | Saul | |
| 2015/0208812 | A1 | 7/2015 | Fenton | |
| 2016/0128500 | A1 | 5/2016 | Yuyungyuen | |

(Continued)

*Primary Examiner* — Robert G Santos

(74) *Attorney, Agent, or Firm* — Dunlap Bennett & Ludwig, PLLC; Anna L. Kinney

(57) ABSTRACT

An ergonomic body pillow includes a substantially cuboid portion joined to a substantially cylindrical portion. The diameter of the cylindrical portion is perpendicular to the longitudinal axis of the cuboid portion. The substantially cuboid portion is firmer than the cylindrical portion. The body pillow keeps the body in a neutral position while side-sleeping.

7 Claims, 2 Drawing Sheets

(56) References Cited

U.S. PATENT DOCUMENTS

| | | | | |
|---|---|---|---|---|
| 2019/0069686 | A1* | 3/2019 | Miller | A47G 9/1036 |
| 2022/0061541 | A1* | 3/2022 | Gregory | A47C 20/021 |

* cited by examiner

ERGONOMIC BODY PILLOW

CROSS-REFERENCE TO RELATED APPLICATION

This application claims the benefit of priority of U.S. provisional application No. 63/072,469, filed Aug. 31, 2020, the contents of which are herein incorporated by reference.

BACKGROUND OF THE INVENTION

The present invention relates to a body pillow and, more particularly, to an ergonomically configured body pillow.

About 16 million adults in the U.S. experience chronic back pain. Chronic hip and low back pain may occur due to prolonged adduction of the lower extremity while side-sleeping. Upper cross syndrome and possibly thoracic outlet syndrome may also be caused due to prolonged rounding of the shoulders while side-sleeping.

None of the currently available body pillows address the need for different widths of pillow between the lower extremities compared to between the upper extremities or the need for a thick cushion in the torso and upper extremity region. Without a deeper pillow in the torso region the pillows are not able to address the upper cross syndrome and thoracic outlet syndrome.

As can be seen, there is a need for a pillow with a component between the lower extremities having a different width than a component between the upper extremities, as well as a thick cushion for support in the torso and upper extremity region.

SUMMARY OF THE INVENTION

The present invention provides a body pillow comprising a cylindrical, bolster-type pillow, preferably customized to the measurements of the subject for the torso and upper extremities, joined to a cuboid, firm pillow configured to provide support between the lower extremities extending the entire length from thigh to toes. The inventive body pillow keeps the body in a neutral position while slide-sleeping. The cuboid, firm pillow portion may be placed between the knees, ankles, and feet and the bolster pillow portion may be placed against the chest with the user's lower arm underneath and the user's upper arm draped on top.

In one aspect of the present invention, an ergonomic body pillow comprising: a substantially cuboid portion and a substantially cylindrical portion joined to an end of the substantially cuboid portion; wherein the diameter of the substantially cylindrical portion is perpendicular to the longitudinal axis of the substantially cuboid portion and the substantially cuboid portion is firmer than the substantially cylindrical portion.

These and other features, aspects and advantages of the present invention will become better understood with reference to the following drawings, description, and claims.

DETAILED DESCRIPTION OF THE INVENTION

Figure 1:
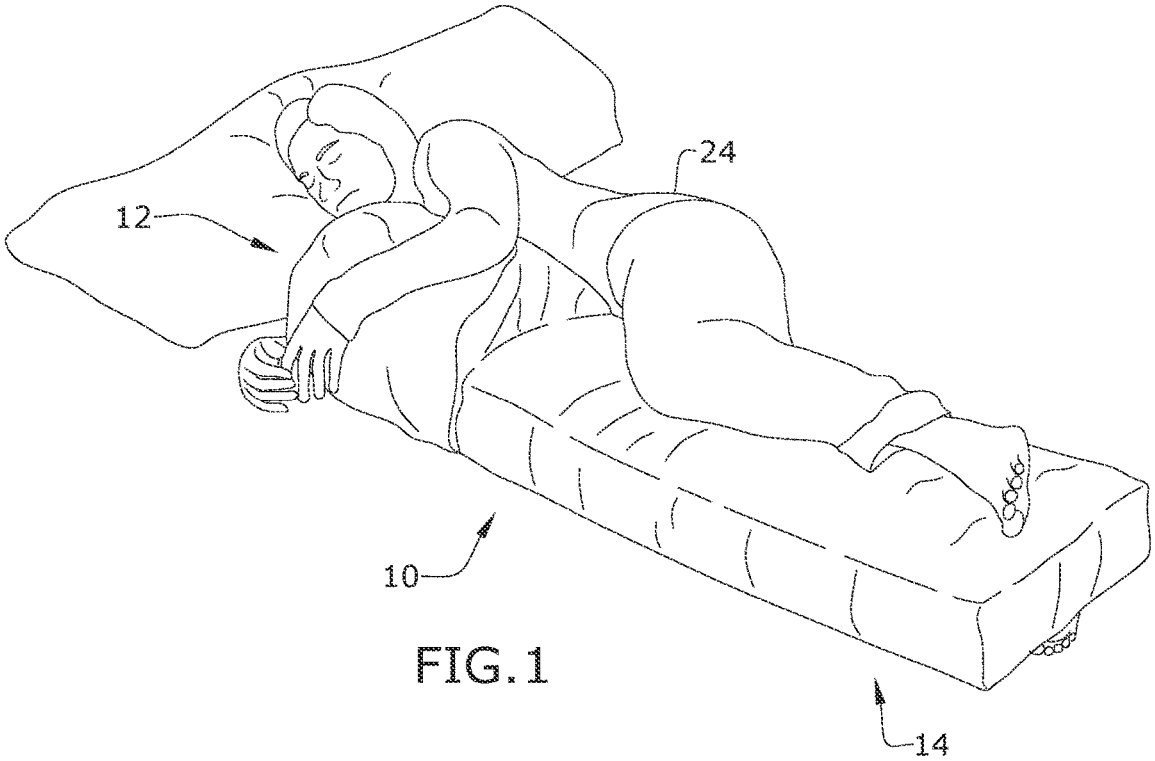
FIG. 1 is a perspective view of a body pillow according to an embodiment of the present invention, shown in use.
Figure 2:
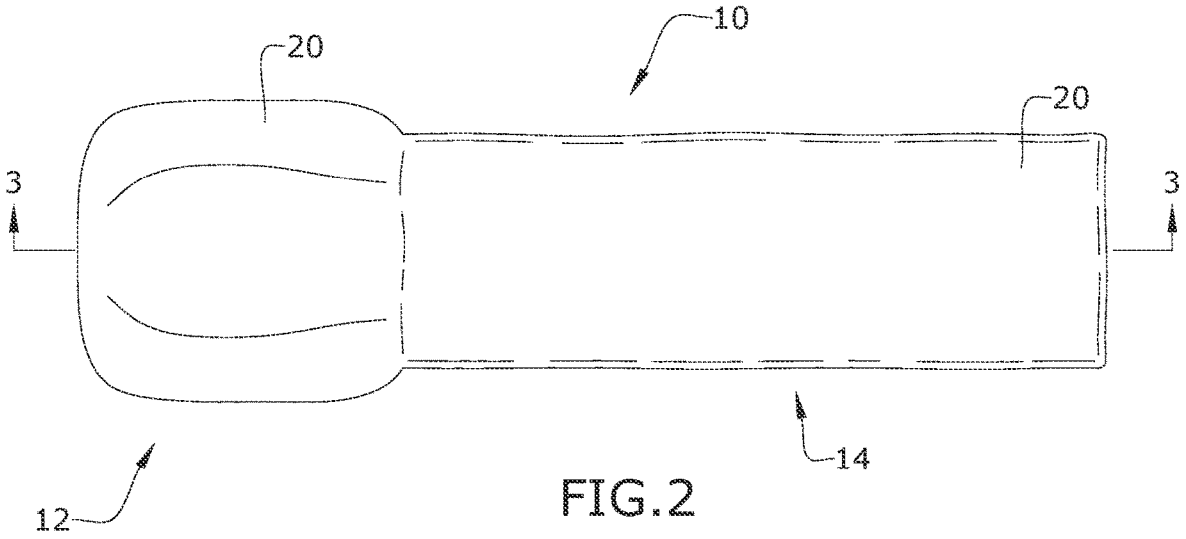
FIG. 2 is a top plan view thereof.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is an ergonomic body pillow having a substantially cuboid portion and a substantially cylindrical portion. The cuboid portion of the unified pillow may be firmly attached to the cylindrical portion of the pillow, with one of the smallest faces of the cuboid portion positioned against an end of the cylindrical portion. This configuration allows the subject to be able to "hug" the top portion while side-sleeping and keep the upper extremities and torso in a neutral position. At the same time, the cuboid portion may be seated between the lower extremities to keep the hips in a neutral position as well.

The diameter and the length of the cylindrical component may be predetermined to conform to a subject's size (e.g., height and torso width).

The materials of construction are not particularly limited. The outer surface of the pillow may comprise cotton fabric, for example. The cylindrical portion of the pillow may be filled with a soft pillow filling or stuffing, such as a natural or synthetic batting. The firmer portion of the pillow may be made from, e.g., memory foam, and may also be wrapped with a layer of fabric batting. Both portions may be contained in an outer fabric lining.

The method of construction is not particularly limited. In an embodiment, an outer fabric may be tightly knit around a soft pillow filling to form a cylinder component. Preferably, the diameter is based on the subject's chest measurement. An outer fabric may also be wrapped or tightly knit around batting surrounding a firm, cuboid pillow material to form a cuboid component. The firm pillow material may be cut to a predetermined height, width, and depth, preferably dependent on the subject's measurements. The cylinder component and the cuboid component may be secured firmly together by any suitable method, such as by sewing. The pillowcase fabric may be cut and sewn to custom-fit the pillowcase around the full pillow. The pillowcase may be fastened using any suitable fastener, such as a hook and loop closure like VELCRO® or a zipper. The fastener is generally operative to retain the removable pillowcase snugly over both portions of the pillow.

In some embodiments, a removable pillowcase may be provided. The pillowcase may fit the contours of both components of the pillow and may have an opening large enough to slide the pillow in and out.

A subject may use the inventive pillow by lying on their side with the cylindrical portion of the pillow in front of their chest, with one arm underneath the pillow and one arm draped over it. The subject may place the cuboid portion of the pillow between their legs from the thigh down to the feet.

Figure 3:
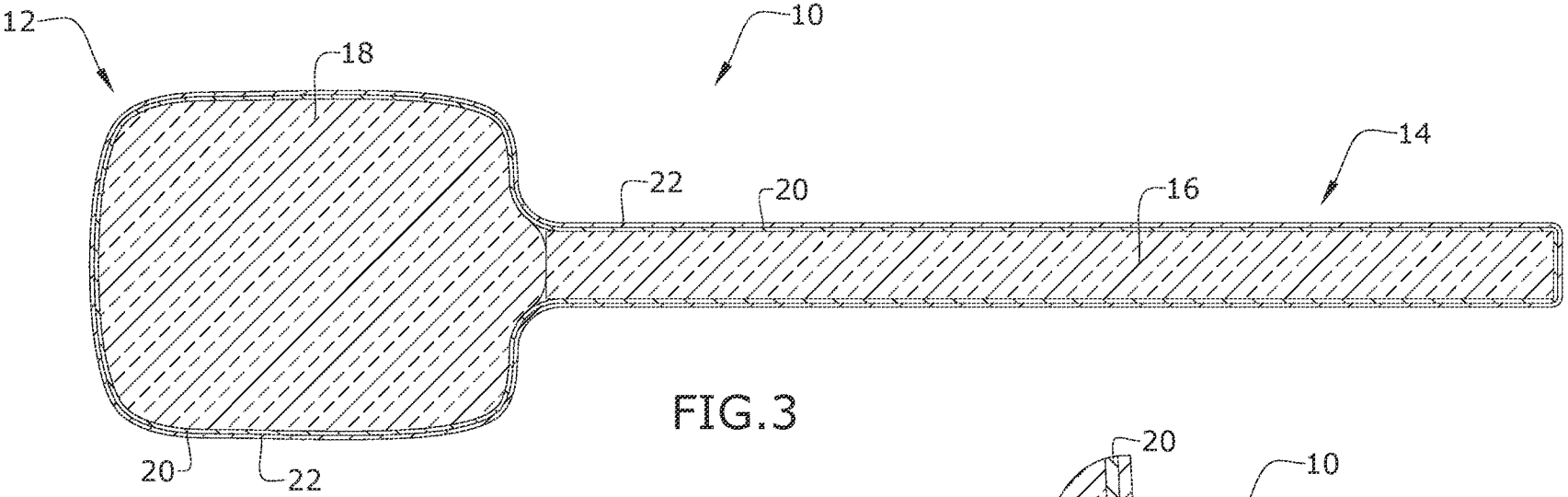
FIG. 3 is a sectional view taken along line 3-3 from FIG. 2.
Figure 4:
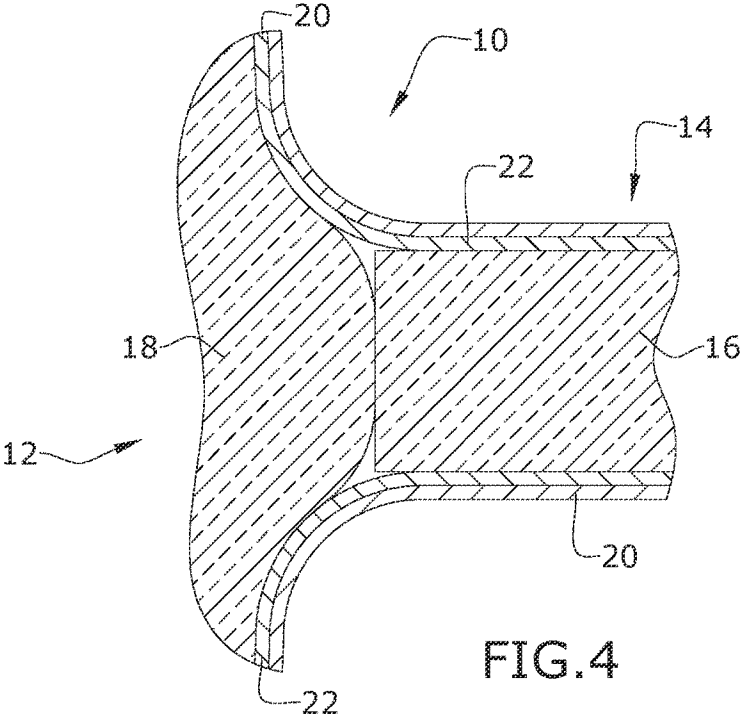
FIG. 4 is an enlarged detail view.

Referring to FIGS. 1 through 4, FIGS. 1 and 2 show a body pillow 10 according to an embodiment of the present invention, integrally comprising an upper pillow 12 and a lower pillow 14. The user 24 may support one arm with, or "hug", the upper pillow 12 to maintain a neutral upper body position. The user may simultaneously support one leg with, or "straddle", the lower pillow 14 to keep the hips in a neutral position. As shown in FIGS. 3 and 4, the body pillow

10 comprises a memory foam 16 core and pillow filling 18 encased in batting material 22 and fabric 20.

It should be understood, of course, that the foregoing relates to exemplary embodiments of the invention and that modifications may be made without departing from the spirit and scope of the invention as set forth in the following claims.

What is claimed is:

1. An ergonomic body pillow comprising:

a substantially cuboid portion having a longitudinal length and a substantially cylindrical portion, having an axial height, joined to an end of the substantially cuboid portion;

wherein a diameter of the substantially cylindrical portion is perpendicular to a longitudinal axis of the substantially cuboid portion and the substantially cuboid portion is firmer than the substantially cylindrical portion;

wherein a total length of the ergonomic body pillow comprises the longitudinal length and the axial height, and the longitudinal length is greater than the axial height, and the diameter is greater than a thickness of the substantially cuboid portion; and wherein the substantially cylindrical portion is configured and dimensioned to be placed against a user's torso, including the user's chest, while the substantially cuboid portion is configured and dimensioned to be placed between the user's legs from thigh to feet.

2. The ergonomic body pillow of claim 1, wherein the diameter of the substantially cylindrical portion and the longitudinal length of the substantially cuboid portion are predetermined to conform to a subject's height and torso width.

3. The ergonomic body pillow of claim 1, wherein the substantially cylindrical portion comprises pillow stuffing.

4. The ergonomic body pillow of claim 1, wherein the substantially cuboid portion comprises batting around a foam core.

5. The ergonomic body pillow of claim 1, wherein the substantially cuboid portion and the substantially cylindrical portion are contained within a fabric lining.

6. The ergonomic body pillow of claim 1, further comprising a removable pillowcase configured to snugly fit both the substantially cuboid portion and the substantially cylindrical portion.

7. The ergonomic body pillow of claim 6, wherein the removable pillowcase further comprises a fastener operative to retain the removable pillowcase on the substantially cuboid portion and the substantially cylindrical portion.

* * * * *